US005423305A

United States Patent [19]

Shih

[11] Patent Number: 5,423,305

[45] Date of Patent: Jun. 13, 1995

[54] IGNITION SYSTEM

[75] Inventor: Yeang-Ming Shih, Hsinchu, Taiwan, Prov. of China

[73] Assignee: Jong-Yih Huang, Taichung, Taiwan, Prov. of China

[21] Appl. No.: 230,730

[22] Filed: Apr. 21, 1994

[51] Int. Cl.[6] ..... F02P 3/06

[52] U.S. Cl. ..... 123/595

[58] Field of Search ..... 123/595, 618, 643, 640, 123/146.5 A, 594

[56] References Cited

U.S. PATENT DOCUMENTS

| | | | |
|---|---|---|---|
| 3,908,622 | 9/1975 | Long | 123/595 |
| 3,933,140 | 1/1976 | Gynn | 123/595 |
| 4,037,577 | 7/1977 | Gallo | 123/595 |
| 4,069,801 | 1/1978 | Stevens | 123/595 |
| 4,404,951 | 9/1983 | Zechlin et al. | 123/595 |
| 4,664,092 | 5/1987 | Kaufmann | 123/640 |
| 5,060,623 | 10/1991 | McCoy | 123/643 |

*Primary Examiner*—Thomas N. Moulis

*Attorney, Agent, or Firm*—Abelman, Frayne and Schwab

[57] ABSTRACT

A direct ignition system includes a main high voltage coil electrically connected to a distributer which has a central pole electrically connected to the main high voltage coil for receiving a high voltage signal therefrom and rotating in concert with an engine, and a plurality of output poles spaced around the central pole and being alternately and repeatedly in electrical contact with the central pole for receiving the high voltage signal when the engine is in rotation, a control circuit comprising a plurality of identical control units each of which is electrically connected to a corresponding one of the output poles of the distributer, a plurality of high voltage coils each of which has a primary winding connected to an output terminal of one of the control units and a secondary winding connected to a corresponding spark plug. Each control unit is adapted to a preceding control unit in such a way that when one of the control units is charged at the high voltage coil thereof, the preceding control unit will enable the high voltage coil to energize the corresponding plug to ignite the corresponding cylinder.

8 Claims, 6 Drawing Sheets

IGNITION SYSTEM

BACKGROUND OF THE INVENTION

1. Field of the Invention

The present invention relates to an ignition system, and more particularly to one which provides direct ignition on a plurality of cylinders.

2. Description of the Prior Art

A car ignition system (as shown in FIG. 4) used at the present time is an indirect ignition system which has a high voltage ignition coil 86 electrically connected to a central pole of a distributor 85 via a high voltage output cable 861. The distributer 85 has a plurality of output terminals 851, 852, 853, and 854 respectively connected to a corresponding one of spark plugs SP1, SP2, SP3, and SP4. The central pole 850 of the distributer 85 is rotated in concert with the engine and thus is sequentially and repeatedly in electrical contact with the first output pole 851, the second output pole 852, the third output pole 853, and the fourth output pole 854 if the engine rotates. Each one of the spark plugs SP1, SP2, SP3, and SP4 is used to ignite a corresponding cylinder (not shown). The cylinders are sequentially and repeatedly ignited one by one by a corresponding spark plug which receives the ignition energy from a corresponding one of the output terminals of the distributer 85. However the energy for igniting all cylinders is merely from the high voltage ignition coil 86, therefore the ignition energy may be not enough for practical use, for example, when the engine is in high speed rotation, the ignition on each cylinder is in a relatively high frequency, which decreases the charging time period of the high voltage coil 86 thus also decreasing the ignition energy of each spark plug and causing ignition failure. Therefore, it can be seen that an indirect ignition system is apt to suffer ignition failure due to a relatively high speed of the engine. In FIG. 3, an available ignition system having a plurality of independent high voltage ignition coils for directly igniting a plurality of cylinders is illustrated. As shown in FIG. 3, a Hall sensor 91 connected to an engine cam of a car engine for detecting an angle status of the engine cam is electrically connected to a microcomputer 90. The microcomputer 90 receives an angle status signal from the Hall sensor 91 and continually outputs a driving signal from one of its four output terminals A, B, C, and D. Each output terminal A, B, C, and D is respectively connected to a corresponding power transistor 92 which is further connected to a corresponding high voltage coil 93. Each high voltage coil 93 is connected to a spark plug 94 for providing ignition energy to energize the latter to ignite a corresponding cylinder. Since a driving signal is continually outputted from one of the four output terminals A, B, C, and D, the power transistors 92 are turned on/off in rotation according to the output status of the output terminals A, B, C, and D, thus causing the related high voltage coil 93 to induce high voltage to energize the related spark plug to ignite the corresponding cylinder. The ignition system as shown in FIG. 3 is a direct ignition system, yet the structure thereof is quite different from the indirect ignition system as shown in FIG. 4 which employs a distributer. Additionally, the Hall sensor 91 of the direct ignition system is merely suitable to some engines which are physically mated with the Hall sensor, thus the conventional indirect ignition system is difficult to be modified to the direct ignition system as shown in FIG. 3.

It is requisite to provide a new ignition system which easily transforms the conventional indirect ignition system to direct ignition system.

SUMMARY OF THE INVENTION

The primary objective of the present invention is to provide an ignition system which provides direct ignition on a plurality of cylinders.

In accordance with one aspect of the invention, there is provided a direct ignition system comprising a main high voltage coil electrically connected to a distributer which has a central pole electrically connected to the main high voltage coil for receiving a high voltage signal therefrom and rotating in concert with a car engine, and a plurality of output poles spaced around the central pole and being alternately and repeatedly in electrical contact with the control pole for receiving the high voltage signal when the car engine is in rotation, a control circuit comprising a plurality of identical control units each of which is electrically connected to a corresponding one of the output poles of the distributer, a plurality of high voltage coils each of which includes a primary winding connected to an output terminal of one of the control units and a secondary winding connected to a corresponding spark plug.

Each of the control units comprises:

a clamper for limiting the high voltage signal to a limited voltage; an inverter for inverting the limited voltage to an inverted voltage; an amplifier for pulling up the inverted voltage to a pulled-up voltage; a D-type flip flop for receiving the pulled-up signal as a clock signal and outputting a logical high voltage when the corresponding output pole is coupled with the central pole yet outputting a logical low voltage when the corresponding output pole is decoupled with the central pole; a charging protector electrically connected to the D-type flip flop for generating a logical low signal in response to a logical low signal from the D-type flip flop and generating a logical high signal in response to a logical high signal from the D-type flip flop; a driving means being connected between the corresponding high voltage coil and a ground and being activated on when the charging protector outputs a logical high signal and being turned off when the charging protector outputs a logical low signal; a triggering stage being adapted to receive the inverted signal from the inverter and responsive to output a logical low signal when receiving a logical high signal and output a logical high signal when receiving a logical low signal.

Each control unit has a corresponding triggering stage thereof connected to a clear terminal of a preceding control unit such that when the control unit is charged at the primary winding of the high voltage coil thereof, the preceding control unit is simultaneously discharged at a secondary winding of the high voltage coil thereof.

In accordance with another aspect of the invention, there is provided a direct ignition system comprising a main high voltage coil electrically connected to a distributer which has a central pole electrically connected to the main high voltage coil for receiving a high voltage signal therefrom and rotating in concert with a car engine, and a plurality of output poles spaced around the central pole and being alternately and repeatedly in electrical contact with the central pole for receiving the high voltage signal when the car engine is in rotation, a control circuit comprising a plurality of identical control units each of which is electrically connected to a corresponding one of the output poles of the distributer, a plurality of high voltage coils each of which has a primary winding connected to an output terminal of one of the control units and a secondary winding connected to a corresponding spark plug.

Each of the control units comprises a clamper for limiting the high voltage signal to a limited voltage; a microprocessor connected to the clamper for receiving the first signal and generating a charging signal in response; a charging protector electrically connected to the microcomputer for generating an enabling signal in response to the charging signal, and generating a disabling signal in response to the second signal; a driving means connected between the corresponding high voltage coil, a ground, and the charging protector so that when the charging protector generates the enabling signal the driving means is activated on and when the charging protector generates the disabling signal the driving means is turned off.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
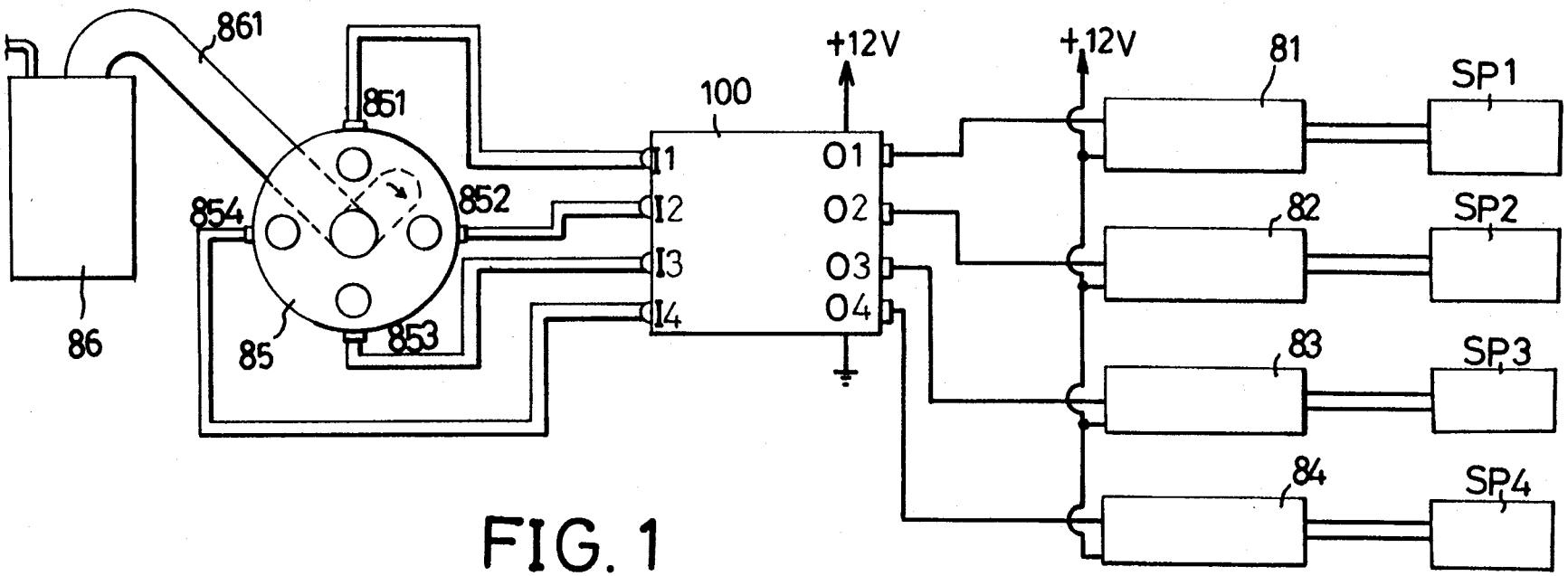
FIG. 1 is a schematic view of a first embodiment of a direct ignition system in accordance with the present invention.
Figure 4:
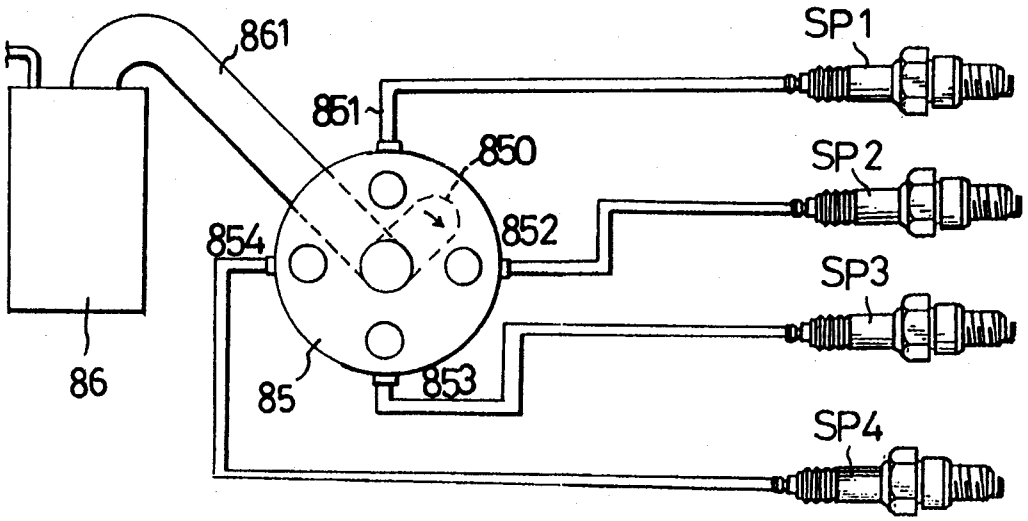
FIG. 4 PRIOR ART
FIG. 4 is a conventional indirect ignition system.

Referring to FIG. 1, a direct ignition system in accordance with the present invention basically is a conventional indirect ignition system (as shown in FIG. 4) plus a control circuit 100 and a plurality of high voltage coils 81, 82, 83, and 84, where the control circuit 100 and the high voltage coils 81, 83, 84, and 82 are connected between the distributer 85 and the spark plugs SP1–SP4. The direct ignition system comprises a high voltage ignition coil 86 electrically connected to a central pole of a distributer 85 via a high voltage output cable 861. The distributer 85 has a plurality of output terminals 851, 852, 853, and 854 near a periphery of the distributer 85. The central pole of the distributer 85 is driven to rotate in concert with the engine and is in electrical contact with the four output terminals alternately and repeatedly. The control circuit 100 includes a plurality of input terminals I1, I2, I3, and I4, and a corresponding number of output terminals 01, 02, 03, and 04. The output terminals 851, 852, 853, and 854 of the distributer 85 are respectively connected to a corresponding one of the input terminals I1, I2, I3, and I4 of the control circuit 100. The output terminals 01, 02, 03, and 04 of the control circuit 100 are respectively connected to a corresponding one of the high voltage coils 81, 82, 83, and 84. The control circuit 100 alternately outputs a driving signal from the output terminals 01, 02, 03, and 04, thus alternately enabling the high voltage coils 81, 82, 83, and 84 to charge and discharge, which in turn alternately energize the spark plugs SP1–SP4 to ignite the corresponding cylinders. It is noted that the added control circuit 100 and the high voltage coils 81, 82, 83, and 84 are easily removed from the direct ignition system of FIG. 1 which thus changes the direct ignition system to the indirect ignition system of FIG. 4. In other words, the indirect ignition system of FIG. 4 is easily changed to the direct ignition system of FIG. 1 by adding the control circuit 100 and the high voltage coils 81–84.

The control circuit 100 can control the charge/discharge of the high voltage coils 81, 82, 83, and 84 by providing precharge effect on the high voltage coils 81, 82, 83, and 84, thus solving the insufficient energy problem occurred on the indirect ignition system.

Figure 2:
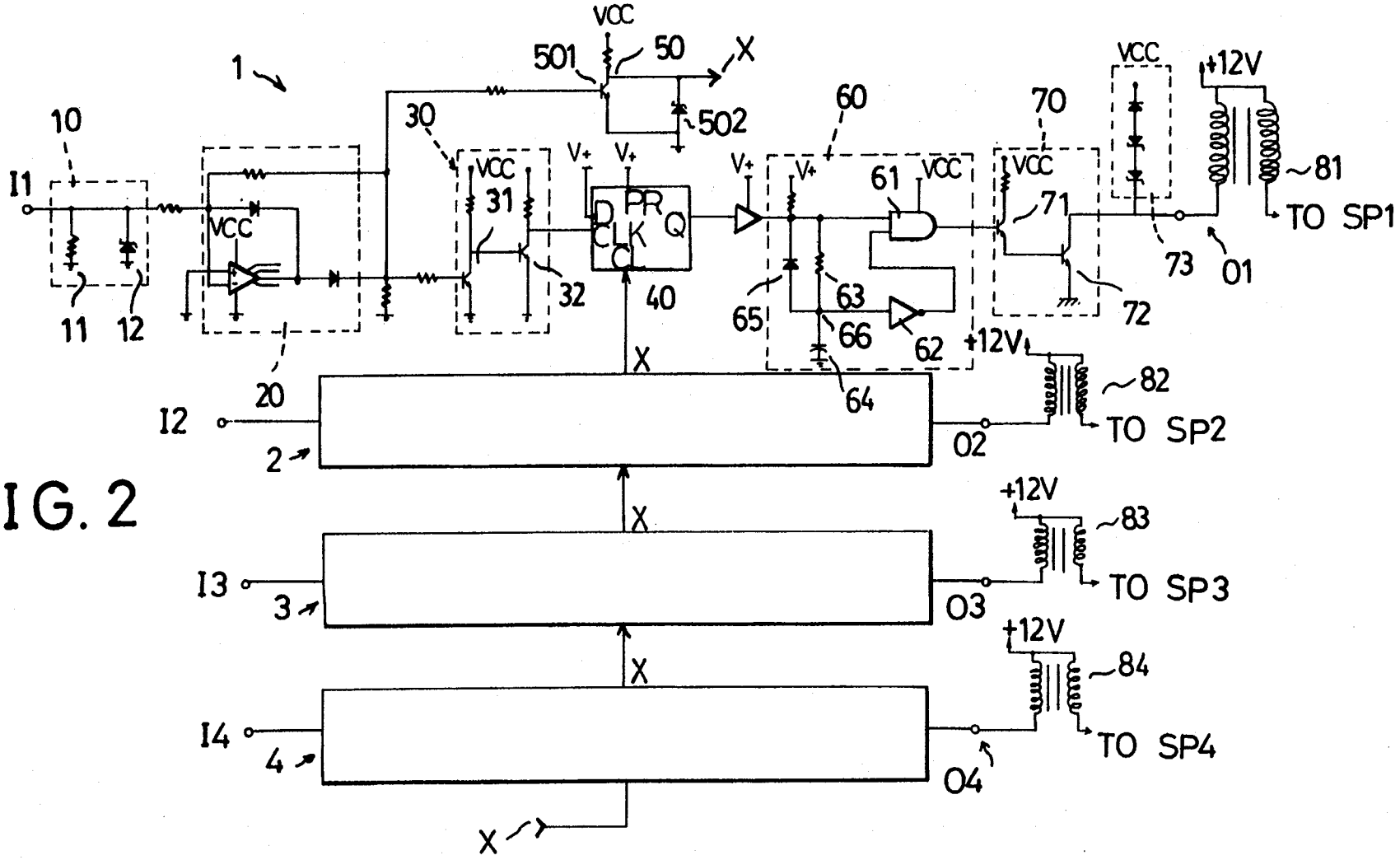
FIG. 2 is a circuit diagram of a control circuit in accordance with the present invention.
Figure 3:
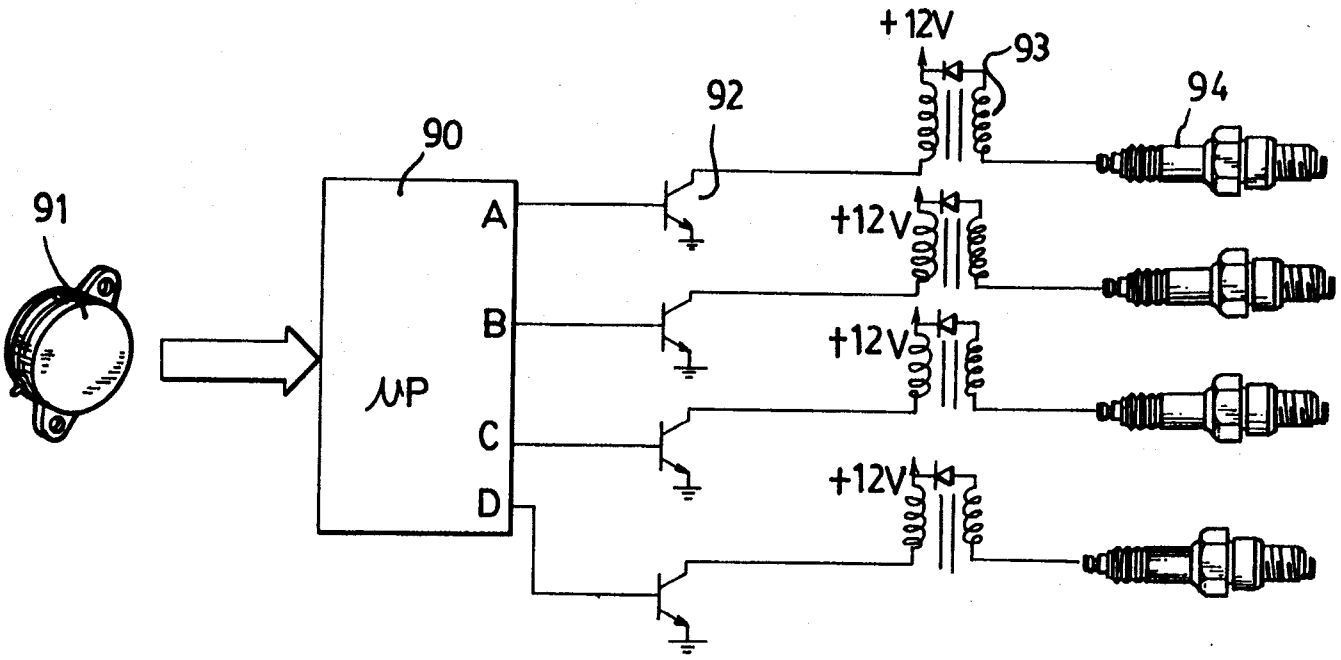
FIG. 3 PRIOR ART
FIG. 3 is a conventional direct ignition system.

Referring to FIG. 2, the control circuit 100 basically comprises four identical control units named first control unit 1, second control unit 2, third control unit 3 and fourth control unit 4. Each of the control units 1, 2, 3, and 4 respectively comprises an input terminal I1, I2, I3, and I4, and an output terminal 01, 02, 03 and 04. Since the four control units are identical, for simplification, only the first control unit 1 is illustrated in detail while other three control units are each shown by a rectangular block. Referring to an upper portion of FIG. 2, each control unit comprises a clamper 10, an inverter 20, an amplifier 30, a D-type flip flop 40, a triggering transistor 50, a charging protector 60, a driving circuit 70, and a protector 73. The clamper 10 comprises a resistor 11 and a zener diode 12 connected in parallel, where the resistor has a resistance of 200 ohms and the zener diode 12 has a zener voltage of 10 volts, thus input voltage from the input terminal I1 is limited below 10 volts. The resistor 11 is employed as a load resistor of the high voltage coil 86, yet the zener diode 12 is in parallel with the resistor 11, thus the voltage across the resistor 11 is about 10 volts and only a small current approximately equaling 5 mA passes through the resistor 11. A voltage-limited signal is obtained across the zener diode 12 and is inputted to the inverter 20.

The inverter 20 comprises an operational amplifier for reversely converting the inputted signal phase. The inverted signal is then coupled to the amplifier 30 and the triggering transistor 50.

The amplifier 30 comprises two transistors 31 and 32 connected as a common emitter configuration for pulling up the signal level from the inverter 20 and coupling the pulled-up signal to a clock input terminal CLK of the D-type flip flop 40.

The triggering stage 50 comprises a transistor 501 and a zener diode 502. The zener diode 502 has two poles respectively connected to a collector and an emitter of the transistor 501. The collector of the transistor 501 is also an output terminal X of the triggering stage 50. The output terminal X of the first control unit 1 is connected to a clear terminal CLR of the D-type flip flop 40 of the fourth control unit 4. It should be noted that the output terminal X of the triggering stage 50 of the second control unit 2 is connected to the clear terminal CLR of the D-type flip flop 40 of the first control unit 1, the output terminal X of the triggering stage 50 of the third control unit 3 is connected to the clear terminal CLR of the D-type flip flop 40 of the second control unit 2, and the output terminal X of the triggering stage 50 of the fourth control unit 4 is connected to the clear terminal CLR of the D-type flip flop 40 of the third control unit 3. A logical high signal is retained at the output terminal Q of the D-type flip flop 40 when the clock input from the amplifier 30 is in logical high, and is changed to a logical low when the clock input is in logical low. The D-type flip flop 40 has an output terminal Q connected to a buffer which retains the output from the flip flop 40 and couples the retained output to the charging protector 60.

The charging protector 60 comprises an AND gate 61, an inverter 62, a resistor 63, a capacitor 64, and a discharging diode 65. When the retained signal from the buffer is in logical low, an output from the AND gate 61 is in logical low. When the retained signal from the buffer is in logical high, an output from the AND gate 61 is in logical high for a time period substantially equaling an RC constant of the resistor 63 and the capacitor 64. It is noted that a node 66 between the resistor 63 and the capacitor 64 is started to be charged from a logical low to a logical high during a first RC constant time period, when the logical status of the buffer is changed from logical low to logical high. After the capacitor 64 is charged to a logical high an output from the inverter 62 is changed from logical high to logical low, which in turn causes an output of the AND gate 61 to change from a logical high to logical low.

The driving circuit 70 comprises a darlinton pair 71 and 72 for current amplification. The driving circuit 70 is ON when the output from the AND gate is in logical high and is OFF when the output from the AND gate 61 is in logical low. The output terminal 01 of the first control unit 1 is defined at a collector of the transistor 72 and is connected to a primary winding of the high voltage coil 81. A secondary winding of the high voltage coil 81 is connected to a corresponding spark plug 94. The clamper protector 73 comprises a plurality of serially connected zener diodes for preventing the output voltage of the output terminal 01 from being beyond a predetermined value.

In the present embodiment, when the first pole 851 of the distributer 85 is in electrical contact with the high voltage coil 86 during the engine rotation, a relatively high voltage signal is coupled to the first input terminal I1 of the first control unit 1 and the output terminal Q of the D-type flip flop 40 is changed from a logical low to a logical high, which in turn activates the driving circuit 70 and thus allows the primary winding of the first high voltage coil 81 to be charged. In the mean time, the triggering stage 50 of the first control unit 1 has its output terminal changes from a logical high to logical low and clears the D-type flip flop 40 of the fourth control unit 4. Similarly, when the second pole 852 of the distributer 85 is in electrical contact with the high voltage coil 86 during the engine rotation, the primary winding of the second high voltage coil 82 is charged. In the mean time, the triggering stage 50 of the first control unit 1 has its output terminal changes from a logical high to logical low and clears the D-type flip flop 40 of the first control unit 1, thus allowing the secondary winding of the first high voltage coil 1 to induce electrical voltage from the primary winding thereof and igniting the first spark plug SP1.

It should be noted that the ignition system of the present invention is not limited to a four-cylinder engine. Since the control units of the control circuit can be produced to any number required by the user, thus the ignition system should not be limited to a specific car. For example, the control units can be three for three-cylinder car, six for six-cylinder car, twelve for twelve-cylinder car, and so on.

Figure 5:
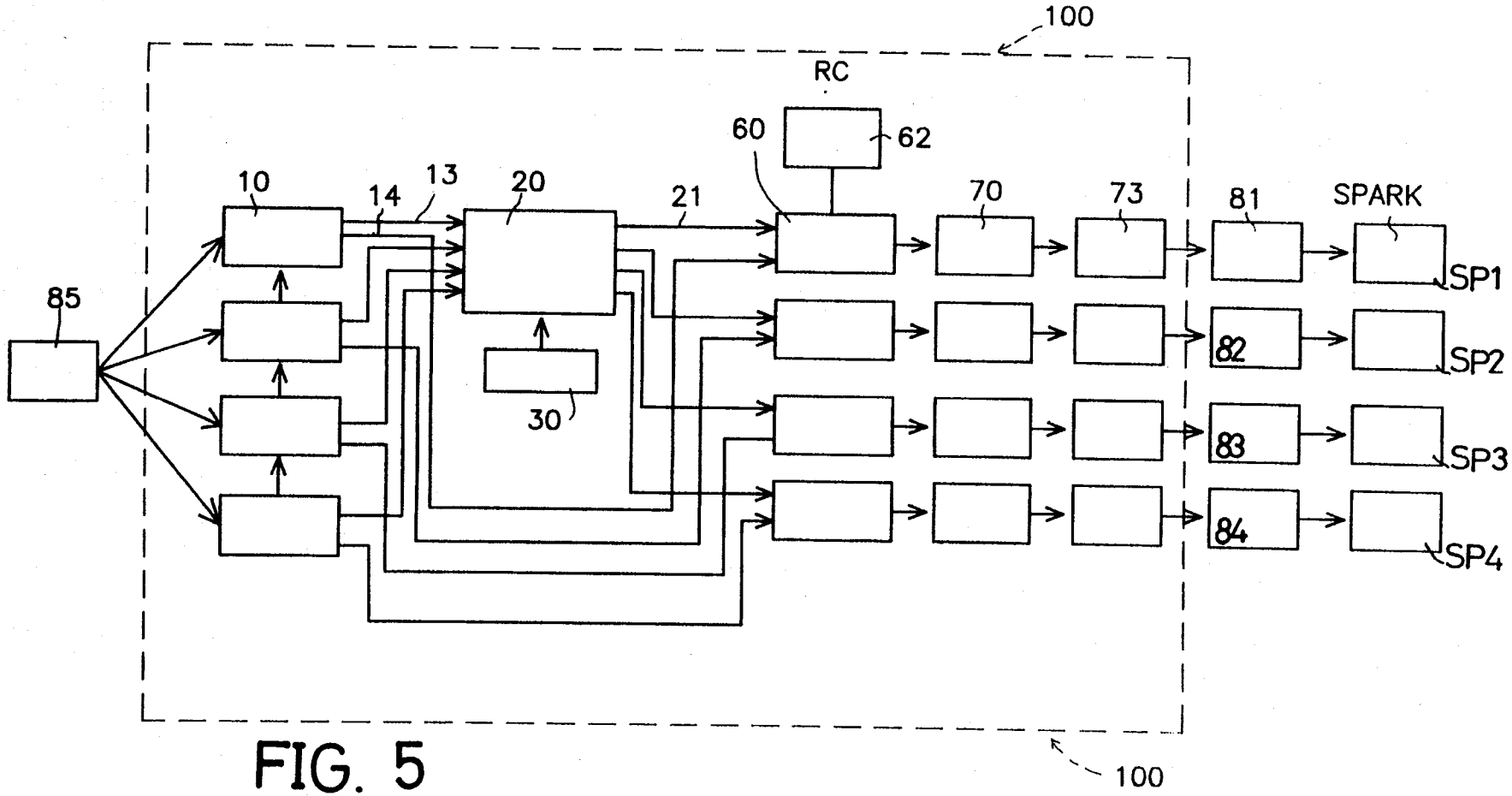
FIG. 5 is a schematic view of a second embodiment of a direct ignition system in accordance with the present invention.
Figure 6:
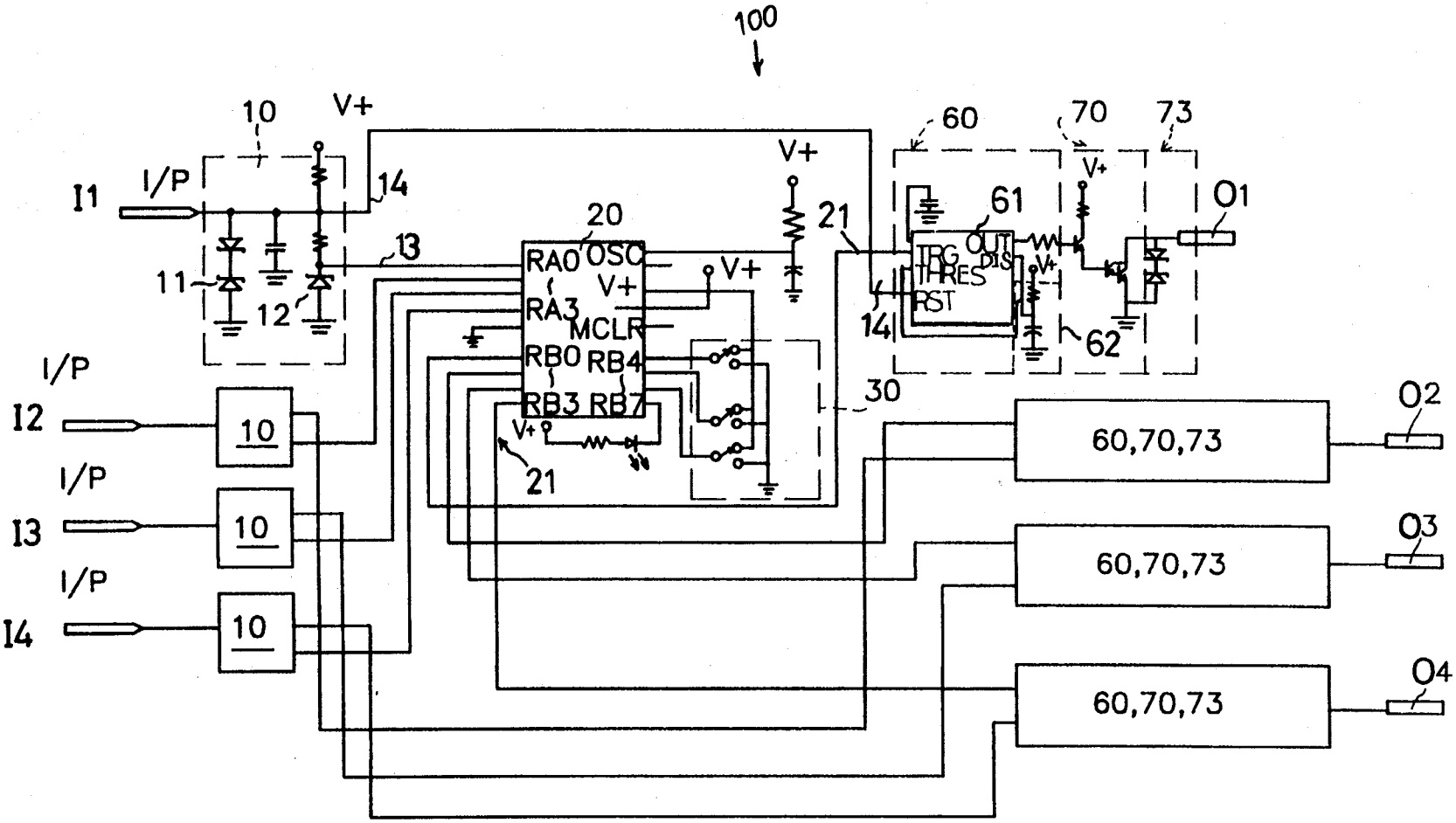
FIG. 6 is a schematic view of a second embodiment of a direct ignition system in accordance with the present invention.

A second embodiment of the present invention is illustrated in FIGS. 5 and 6. In this embodiment some components are identical to or equivalent to those of the first embodiment such as the distributer 85, the clamper 10, the charging protector 60, the driving means 70, the clamper protector 73. The major change of the second embodiment is to introduce a microprocessor 20, a selection switch 30, and a time up circuit 62.

Referring to FIG. 5, the clamper 10 sends out a first signal 13 to the charging protector 60 and a second signal 14 to the microprocessor 20. The first signal 13 is a trigger signal for activating the charging protector 60, which in turn enables the high voltage coil 81 to energize the spark plug, for example SP1, which in turn ignites the corresponding cylinder. The second signal 14 informs the microprocessor 20 that the related spark plug SP1 is igniting the corresponding cylinder and the microprocessor 20 can respond to assign next control unit 2 to be charged. The microprocessor 20 counts a time interval between two ignition times for a same cylinder thus the microprocessor can predict next time for the same cylinder to be ignited. The microprocessor 20 outputs a charging signal 21 from one of its output terminals to a related charging protector 60 and thus enabling the driving means 70 to charge the related high voltage coil 81.

Referring to FIG. 6, the clamper 10 comprises a plurality of zener diodes 11, 12, resistors and a capacitor. The high voltage input signal from the distributer 85 is limited to substantially 5 to 10 volts which is the first signal 13. The second signal 14 substantially equaling 5 volts is obtained from the first signal at a node between the resistor and the zener diode. The microprocessor 20 has a plurality .of output terminals RB4 to RB7 connected to the selection switches 30 allowing a user to selectively set different charging times of the corresponding high voltage coils 81, 82, 83, and 84. The microprocessor 20 has a plurality of output terminals RB0, RB1, RB2, RB3 respectively outputting a charging signal 21 to a corresponding charging protector 60 which comprises an unstable oscillator 61 and an RC time up circuit 62. The unstable oscillator 61 has a trigger input terminal TRG for receiving the charging signal 21 and a reset terminal RST for receiving the second signal 14. The RC time up circuit 62 has a node between the resistor and the capacitor connected to a threshold terminal THR and a discharging terminal DIS of the unstable oscillator 61. The oscillator 61 has an output terminal OUT connected to the high voltage coil 81 via the driving means 70. The RC time up circuit 62 is used to limit the logical high voltage working cycle. When the trigger terminal TRG of the oscillator 61 is triggered by the charging signal 21, it sends out a logical high signal to the activate the connected driving means 70, thus enabling the high voltage coil to be charged. The oscillator 61 changes its output from logical high to low when the first signal 13 is sent to the reset terminal RST thereof, thus turning off the driving means 70, which in turn causes the high voltage coil 81 to discharge to the spark plug SP1 and igniting the corresponding cylinder.

It should be noted that the two ignition systems of the present invention are not limited to car engines but suitable to other kinds of engines.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A direct ignition system comprising a main high voltage coil electrically connected to a distributer which has a central pole electrically connected to the main high voltage coil for receiving a high voltage signal therefrom and rotating in concert with an engine, and a plurality of output poles spaced around said central pole and being alternately and repeatedly in electrical contact with said central pole for receiving said high voltage signal when said engine is in rotation, a control circuit comprising a plurality of identical control units each of which is electrically connected to a corresponding one of said output poles of said distributer, a plurality of high voltage coils each of which has a primary winding connected to an output terminal of one of said control units and a secondary winding connected to a corresponding spark plug, the improvement comprising:

each of said control units comprising a clamper for limiting said high voltage signal to a limited voltage;

an inverter for inverting said limited voltage to an inverted voltage;

an amplifier for pulling up said inverted voltage to a pulled-up voltage;

a D-type flip flop for receiving said pulled-up signal as a clock signal and outputting a logical high voltage when said corresponding output pole is coupled with said central pole yet outputting a logical low voltage when said corresponding output pole is decoupled with said central pole;

a charging protector electrically connected to said D-type flip flop for generating a logical low signal in response to a logical low signal from said D-type flip flop and generating a logical high signal in response to a logical high signal from said D-type flip flop;

a driving means connected between said corresponding high voltage coil and a ground and being activated on when said charging protector outputs a logical high signal and being turned off when said charging protector outputs a logical low signal;

a triggering stage being connected to receive said inverted signal from said inverter and responsive to output a logical low signal when receiving a logical high signal and output a logical high signal when receiving a logical low signal;

whereby each said control unit has a corresponding triggering stage thereof connected to a clear terminal of a preceding control unit such that when said control unit is charged at the primary winding of said high voltage coil thereof, said preceding unit is simultaneously discharged at a seconding winding of said high voltage coil thereof.

2. The direct ignition system as claimed in claim 1 further comprising a clamper protector for limiting the output voltage of said driving means in a predetermined threshold.

3. The direct ignition system as claimed in claim 1, wherein said clamper comprises a resistor and a zener diode connected in parallel.

4. The direct ignition system as claimed in claim 1, wherein said amplifier comprises two transistors connected as a common emitter configuration.

5. The direct ignition system as claimed in claim 1, wherein said charging protector comprises an AND gate, an inverter, a resistor, a capacitor, and a discharging diode.

6. The direct ignition system as claimed in claim 1, wherein said triggering stage comprises a transistor and a zener diode, said zener diode having two poles respectively connected to a collector and an emitter of said transistor.

7. A direct ignition system comprising a main high voltage coil electrically connected to a distributer which has a central pole electrically connected to the main high voltage coil for receiving a high voltage signal therefrom and rotating in concert with an engine, and a plurality of output poles spaced around said central pole and being alternately and repeatedly in electrical contact with said central pole for receiving said high voltage signal when said engine is in rotation, a control circuit comprising a plurality of identical control units each of which is electrically connected to a corresponding one of said output poles of said distributer, a plurality of high voltage coils each of which has a primary winding connected to an output terminal of one of said control units and a secondary winding connected to a corresponding spark plug, the improvement comprising:

each of said control units comprising a clamper for limiting said high voltage signal to a limited voltage;

a microprocessor connected to said clamper for receiving said first signal and generating a charging signal in response, a charging protector electrically connected to said microcomputer for responding to said charging signal and generating an enabling signal, and responding to said second signal and generating a disabling signal;

a driving means connected between said corresponding high voltage coil, a ground, and said charging protector so that when said charging protector generates said enabling signal said driving means is activated on and when said charging protector generates said disabling signal said driving means is turned off.

8. The direct ignition system as claimed in claim 7 further comprises a time up circuit for determining a charging time period when said high voltage coil is charged.

* * * * *